United States Patent [19]

Hahn

[11] Patent Number: 4,923,199

[45] Date of Patent: May 8, 1990

[54] WORD MAKING CARD GAME

[76] Inventor: Eugene W. Hahn, 426 Sterling Pl., Apt. 1C, Brooklyn, N.Y. 11238

[21] Appl. No.: 322,120

[22] Filed: Mar. 13, 1989

[51] Int. Cl.[5] ..... A63F 1/00

[52] U.S. Cl. ..... 273/299; 273/272

[58] Field of Search ..... 273/299, 240, 272

[56] References Cited

U.S. PATENT DOCUMENTS

| | | | |
|---|---|---|---|
| 1,076,307 | 10/1913 | Nicholson | 273/299 X |
| 3,195,895 | 7/1965 | Kropinski | 273/240 |
| 4,350,342 | 9/1982 | Barulich | 273/272 X |

FOREIGN PATENT DOCUMENTS

| | | | |
|---|---|---|---|
| 2247265 | 5/1975 | France | 273/272 |
| 449879 | 7/1936 | United Kingdom | 273/299 |

*Primary Examiner*—Edward M. Coven
*Assistant Examiner*—Raleigh W. Chiu
*Attorney, Agent, or Firm*—Notaro & Michalos

[57] ABSTRACT

A word game utilizes a deck of sixty cards having letters that appear in numbers corresponding to their frequency of use in the English language. Six E's are provided, for example, while one each are provided of J, K, Q, V, X and Z. Fifteen cards are dealt to each player who must then make as many words as possible from the fifteen letters, using the letters again from word to word. The words are scored based on length with one point being given for each word having three letters and a larger number of points being given for words having a greater number of letters, up to the maximum of fifteen letters, for any one word.

5 Claims, 1 Drawing Sheet

WORD MAKING CARD GAME

FIELD AND BACKGROUND OF THE INVENTION

The present invention relates in general to word games and, in particular, to a word game utilizing a deck of cards wherein each card carries a letter. The frequency of cards having a particular letter in the deck is selected to roughly mimick the frequency with which that letter is used in forming words in the English language.

Word games are known which utilize a deck of cards that each carry one or more letters.

U.S. Pat. No. 4,333,656 to Sommer discloses a card game where each card of the deck has one or more letters of the alphabet, players make words out of the cards and are awarded points. The point system of Sommer is to award more points for words that utilize letters that occur less often in the English language. One hundred and four cards are included in the deck.

U.S. Pat. No. 2,783,998 to Collins discloses a word game using cards which each carry more than one letter. As many as four players can be accommodated by one deck having one hundred and twelve cards. Again, words are made with the cards but, this time, the scoring system is based on the number of letters in each word. Letters are provided at the corners of the cards, so that the cards can be "fanned out" for easy reading of the words.

U.S. Pat. No. 2,265,334 to Armbruster discloses a word game using a relatively small number of cards and utilizing a point system based on the occurrence of letters in the English language. See also U.S. Pat. No. 1,399,811 to Smith and 2,766,987 to Seelbrede et al, for other word games utilizing cards.

SUMMARY OF THE INVENTION

The present invention comprises a card game utilizing sixty cards, each carrying a letter of the alphabet. The distribution of the letters among the cards is as follows:

6 E's, 5 A's, 4 each of I, 0 and U, 3 Y's, 1 each of J, K, Q, V, X and Z, and 2 each of the remaining consonants.

This selection of letters was chosen so that a random distribution of fifteen of the sixty cards would give a player a good chance of making the largest number of words.

The game can be played by two to four players. To begin the game, the cards are shuffled, then, fifteen cards are distributed to each player. Each player then lists the fifteen letters he (she) has been dealt on a worksheet. The worksheet contains blocks, each having fifteen columns (corresponding to the fifteen letters) and twenty-five rows in the vertical direction. This has been found to be an optimum number of rows. Each row is meant to receive a distinct word that the player can make with his/her selection of fifteen letters. The players each have exactly five minutes to make as many words as possible from their fifteen letters.

The scoring is as follows:

Each word having three letters is worth 1 point.
Each word having four letters is worth 2 points.
Each word having five letters is worth 4 points.

The number of points increases in the manner shown on the worksheet, up to the maximum of 100 points for a fifteen letter word.

At the end of the five minute phase or cycle, each player counts up the number of points. At the end of the cycle, each player passes his/her fifteen cards to the player on his/her left, so that each player now has the set of cards formerly held by the player on his/her right. A new five minute cycle then begins. Four complete phases or cycles of five minutes each, form one full game. To add interest to the game, each worksheet for each cycle could have a different color. The first worksheet, for example, can be red, the following yellow, the following blue, and the last one green.

Additional rules are that no abbreviations, plurals, prefixes, suffixes, foreign words, combining forms, slang, proper nouns, contractions or hyphenated words, may be used. In addition, ten points are also deducted from the score for each duplicated word. Ten points are deducted for each mis-spelled word. Twenty points are deducted for any letter not among the fifteen letters given to that player.

Other variations of the game may also be provided to utilize physical parts of the game. These parts include the deck of sixty cards, a set of worksheets and any timing device which is capable of measuring out a five minute period.

DESCRIPTION OF THE PREFERRED EMBODIMENT

Figure 1:
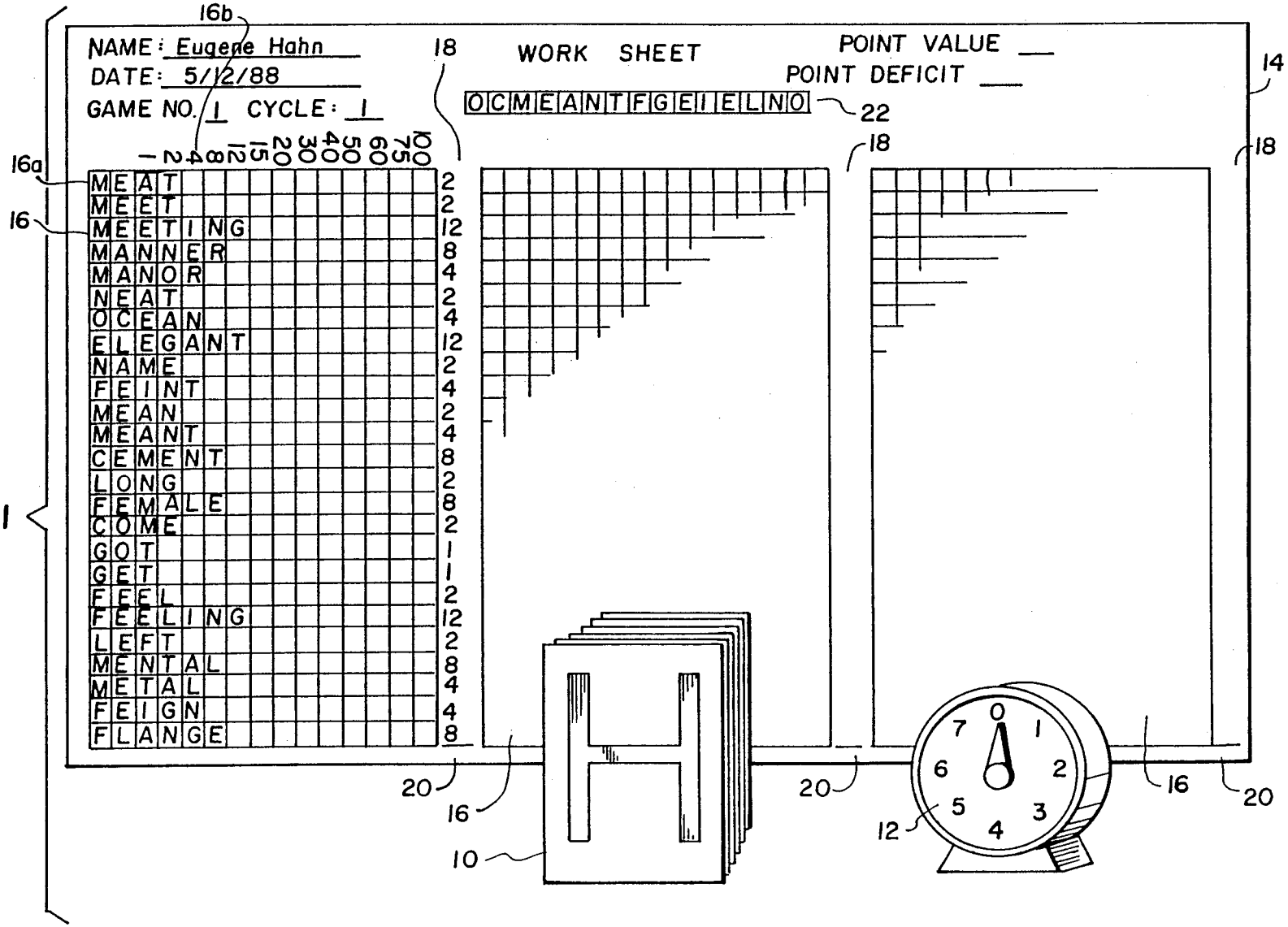
FIG. 1 is a representation of the physical parts of the inventive game, including a representative worksheet, the deck of cards and a timing device.

Referring to the drawing in particular, the invention embodied therein comprises a game having physical parts, including a deck of sixty cards 10, a timing device 12, and a plurality of worksheets. The sixty cards in the deck 10 each carry one letter with the following distribution of letters in the deck:

6 E's, 5 A's, 4 each of I, 0 and U, 3 Y's, 1 each of J, K, Q, V, X and Z, and 2 each of the remaining consonants.

This distribution of letters is selected to roughly mimick the frequency with which these letters appear in words in the English language. In this way, shuffling the deck and dealing out a number of cards to a player will provide the player with a good selection of letters for making the largest number of words. At the same time, this avoids, in the scoring system, the need for some mechanism for providing additional points for letters which are used less frequently in the English language. According to the present invention, scoring is based primarily on the length of words that are made with the available letters, with penalties being assessed for certain faults, such as listing duplicate words, mis-spelling words, and the like.

The use of the worksheet as part of the game procedure aids both in practising the game and in scoring the results of the game.

The worksheet 14 has one or more tables 16, which each have fifteen vertical columns (to accommodate the longest possible word that can be made with the fifteen letters dealt to a particular player). Each table also has as many rows as will fit. A player may use the additional tables available on his/her worksheet, if needed.

The total for each word (that is each row on a table) is placed in a scoring column 18 and totalled at the bottom of each column at 20. The total scores are then taken for each of the tables. Any assessed penalties for faults are then subtracted to yield the final score. Timer 12 is provided to constrain each player to a five minute or other advantageous period.

In playing the game, the set of fifteen letters can be re-used for each word. For example, if two E's have been dealt to a player among his/her fifteen. cards, words containing two E's may be formed. Words containing three E's, however, may not be formed, since the set of fifteen cards (letters) may only be used once for forming each word.

The letters of each word are placed in one row 16*a*. The length of the letter will indicate the score. The score value for the length of each word is positioned above each column at 16*b*. The numerical scoring for words having ever increasing length also increases. For example, a four letter word scores 2 points, while a five letter word scores 4 points (a difference of 2 points). A nine letter word scores 20 points, while a ten letter word scores 30 points (a difference of 10 points). The pointing system is shown on the worksheet 14.

To begin play, from two to four players are each dealt fifteen cards from the deck 10 which has previously been shuffled. Each player then marks down his/her fifteen letters in an area 22 near the top of the worksheet. There is no need to keep the letters secret since another player is given no advantage by viewing the letters. This also permits the cards to be returned to the deck to avoid distractions.

To give all players an equal five minute period, before play, the worksheets are placed face down and the cards are dealt out. When signaled by a director or referee, all players may view their worksheets and cards and begin play. Each word is legibly printed with one letter per box, in table 16. After the five minute period has elapsed, scores are taken at the subtotal column 18, these are then added at the total space 20 at the bottom of each column, and then accumulated for all tables used. Penalty points are then assessed.

Preferably, the game is played with four such phases during which new selections of cards are dealt out to the players. This tends to average out the random elements of play where one player may perhaps receive a particularly poor selection of cards which renders it difficult to make words. Another variation of the game is to have each player pass the fifteen cards to the next player. This player then receives a fresh set of fifteen cards from another player. In this way, all players are faced with equally difficult or easy sets of cards.

The invention claimed is:

1. A method of playing a multicycle word game comprising:

dealing out a set of fifteen cards to each of from two to four players, from a shuffled deck containing sixty cards, each card carrying one letter with the frequency of cards containing each letter being roughly the same as the frequency with which each letter occurs in the English language, there being more cards containing letters which are more frequently used and less cards containing letters which are less frequently used;

selecting a period of time for one cycle of the game during which each player forms as many words as possible from the set of fifteen cards dealt to that player, the game having a number of cycles which is equal to the number of players;

issuing to each player, a number of worksheets equal to the number of cycles of the game, each player marking on one of the worksheets issued to that player, the fifteen cards dealt to that player, and each word formed by that player, each word on the worksheet using only letters available from the fifteen cards with subsequent words on the worksheet being allowed to re-use letters appearing in the fifteen cards;

scoring each player for each cycle by assessing the value of each word made by each player on the basis of the length of each word with longer words being scored higher than shorter words, each player passing the fifteen cards originally dealt to that player, to a neighboring player to commence a second cycle of the game, so that each player has a new set of fifteen cards, each player marking on a second one of the worksheets issued to that player, the letters of the newly received fifteen cards and as many words as possible formed with the newly received set of fifteen cards during the second cycle; and repeating the passing of the sets of fifteen cards from each player to a neighboring player until all players have received all the dealt sets of fifteen cards.

2. A method according to claim 1 including deleting from the score of each player for each cycle, a selected amount for each incorrectly spelled word and for each word which was made with letters which were not among the set of fifteen cards held by each player during that cycle.

3. A method according to claim 1, including scoring only words having at least three letters.

4. A method according to claim 1, wherein the letters represented on cards in the deck appear with the following frequency:

6 E's, 5 A's, 4 each of I, 0 and U, 3 Y's, 1 each of J, K, Q, V, X and Z, and 2 each of the remaining consonants.

5. A method according to claim 4, wherein scoring for words containing three to fifteen letters are:

1; 2; 4; 8; 12; 15; 20; 30; 40; 50; 60; 75 and 100, respectively.

* * * * *